US005198135A

United States Patent [19]

Galic et al.

[11] Patent Number: 5,198,135

[45] Date of Patent: * Mar. 30, 1993

[54] ANTIEMULSION/ANTIFOAM AGENT FOR USE IN OILS

[75] Inventors: Mary Galic, Euclid; Scott T. Jolley, Mentor; Mary F. Salomon, Cleveland Heights, all of Ohio

[73] Assignee: The Lubrizol Corporation, Wickliffe, Ohio

[ * ] Notice: The portion of the term of this patent subsequent to Jan. 28, 2009 has been disclaimed.

[21] Appl. No.: 740,694

[22] Filed: Aug. 6, 1991

Related U.S. Application Data

[63] Continuation of Ser. No. 586,469, Sep. 21, 1990, Pat. No. 5,084,197.

[51] Int. Cl.[5] ..... C10M 145/00

[52] U.S. Cl. ..... 252/52 A; 252/358; 585/3

[58] Field of Search ..... 252/52 A, 358; 585/3

[56] References Cited

U.S. PATENT DOCUMENTS

| | | | |
|---|---|---|---|
| 2,964,473 | 12/1960 | Hughes et al. | 252/18 |
| 3,862,243 | 1/1975 | Bellos | 252/358 |
| 3,966,625 | 6/1976 | Tanizaki et al. | 252/52 A |
| 4,793,939 | 12/1988 | Mori et al. | 252/52 A |
| 5,084,197 | 1/1992 | Galic et al. | 252/52 A |

FOREIGN PATENT DOCUMENTS

| | | |
|---|---|---|
| 651607 | 6/1984 | Belgium . |
| 0110003 | 12/1964 | European Pat. Off. . |
| 0190869 | 8/1986 | European Pat. Off. . |
| 0384724 | 8/1990 | European Pat. Off. . |
| 1444844 | 10/1969 | Fed. Rep. of Germany . |
| 1169853 | 3/1957 | France . |
| 1448210 | 6/1965 | France . |

OTHER PUBLICATIONS

Lubricant Additives, C. V. Smalheer and R. K. Smith, 1967, Cleveland, Ohio.

*Primary Examiner*—Jacqueline Howard

*Attorney, Agent, or Firm*—David M. Shold; Forrest L. Collins

[57] ABSTRACT

The present invention deals with a particular antiemulsion agent which is useful in retarding foam and/or emulsion formation in an engine. In particular, the agent is effective at preventing or retarding emulsion or foaming in an engine oil.

17 Claims, No Drawings

ANTIEMULSION/ANTIFOAM AGENT FOR USE IN OILS

This is a continuation of copending application Ser. No. 07/586,469 filed on Sep. 21, 1990 now U.S. Pat. No. 5,084,197.

BACKGROUND OF THE INVENTION

1. Field of the invention.

The present invention deals with materials which retard emulsion or foam formation in an oil.

2. Description of the art.

Benoit in U.S. Pat. No. 2,813,129 issued Nov. 12, 1957 describes high molecular weight polyglycols and a method for their production. Harding et al in U.S. Pat. No. 4,617,984 issued Oct. 21, 1986 describes polytetra (methylene oxide) or poly (trimethylene oxide) homopolymers having molecular weights of from about 300 to about 1,000.

Login et al in U.S. Pat. No. 4,245,004 issued Jan. 13, 1981 describes block copolymer lubricants for synthetic textile fibers which are derived from tetramethylene oxide (tetrahydrofuran) and ethylene oxide. Uchinuma in U.S. Pat. No. 4,248,726 issued Feb. 3, 1981 describes a high-viscosity refrigerator oil obtained from a polyglycol oil such as polyoxypropylene glycol or an alkyl ether thereof.

U.S. Pat. No. 4,263,167 to Mago described poly (alkylene oxide) compositions which are stated to be resistant to oxidative degradation and which inhibit the corrosion of ferrous metals. Harold in U.S. Pat. No. 3,634,244 issued Jan. 11, 1972 describes alkylene polyethers which are soluble in mineral oil and having a molecular weight of 10,000 or greater which may be utilized as a viscosity index improving additive in a lubricating oil composition.

Riemenschneider in U.S. Pat. No. 3,004,837 issued Oct. 17, 1971 describes two-cycle engines and lubricant additives which are useful in the formulation of such fuels. The particular additives which Riemenschneider is utilizing include polypropylene glycol having a molecular weight of at least 600. U.S. Pat. No. 3,509,052 issued to Murphy Apr. 28, 1970 describes polyoxyalkylene glycols in lubricants.

Jacobson et al in U.S. Pat. No. 3,382,055 issued May 7, 1968 describes polymers of 1,2-epoxy alkanes having 10 to 18 carbon atoms which may be utilized as pour depressants for middle distillates and light lube oil stocks.

McCoy in U.S. Pat. No. 3,789,003 issued Jan. 29, 1974 describes a process for coverting normally oil-insoluble, high molecular poly (alkylene) oxides into oil-soluble complexes by treatment with alkylated phenol-type compounds. Herold in U.S. Pat. No. 3,829,505 issued Aug. 13, 1974 describes hydroxy terminated polyethers which are stated to be useful as non-ionic surface active agents, lubricants and coolants.

Latos in U.S. Pat. No. 3,847,828 issued Nov. 12, 1974 describes the working of non-ferrous metals through the use of a lubricant containing a polyglycol. Davis in U.S. Pat. No. 3,919,093 issued Nov. 11, 1975 describes lubricant compositions containing anti-wear amounts of mixtures of an alkylene oxide polymer and sulfur. The use of certain 1,4-butanediol polymers is described in a du Pont brochure entitled Terathane ® Polyether Glycol marked as E-77911 11/85 (2M).

The present invention is particularly concerned with antiemulsion/antifoam properties of certain polymers in a lubricating oil. In particular the polymers prevent or minimize foaming and emulsion formation in a IID engine test and in field test conditions prone to produce emulsions.

To the extent that any reference cited in this application is applicable to the present invention it is herein specifically incorporated by reference. Percentages and ratios are by weight unless otherwise indicated. Temperatures are in degrees Celsius, and pressures are in KPa gauge unless otherwise indicated. To further define and illustrate the invention ranges and ratios given herein may be cross-combined.

SUMMARY OF THE INVENTION

The present invention describes a crankcase lubricating oil composition containing as an antiemulsion agent an effective amount of a butylene oxide containing polymer.

A further feature of the present invention is a composition comprising:

(A) a polymer corresponding to the formula $HO(CH_2CH_2CH_2CH_2O)_nH$ wherein n is from 10 to 50; and at least one of B-F:

(B) at least one of a sodium, calcium or magnesium detergent;

(C) a dispersant;

(D) a zinc dialkyldithiophosphate;

(E) a viscosity improver; and (F) an antioxidant.

Still a further embodiment of the present invention is a concentrate containing optionally 10 to 7 parts by weight of an oil of lubricating viscosity and 30 to 90 parts by weight of:

(A) a polymer corresponding to the formula $HO(CH_2CH_2CH_2CH_2O)_nH$ wherein n is from 10 to 50; and at least one of B-F:

(B) at least one of a sodium, calcium or magnesium detergent;

(C) a dispersant;

(D) a zinc dialkyldithiophosphate;

(E) a viscosity improver; and (F) an antioxidant.

The present invention further contemplates a method of reducing emulsion and/or foam formation in a lubricating oil by including therein an effective amount of:

$$HO(CH_2CH_2CH_2CH_2O)_nH$$

or a copolymer thereof wherein n is from 10 to 50.

Still yet another embodiment of the present invention is a method for reducing emulsion and/or foam formation in a lubricating oil by including therein an effective amount of a butylene oxide polymer, copolymer or terpolymer.

DETAILED DESCRIPTION OF THE INVENTION

The present invention contemplates a motor oil capable of meeting current API standards (American Petroleum Institute) with regard to necessary properties for a passenger car motor oil. In particular, one aspect of obtaining a motor oil useful under today's driving conditions is one which passes the IID test.

Stated succinctly, the IID test is one which is intended to simulate driving conditions of a short duration where the engine never reaches its normally intended operating temperature. Several things can and will go wrong with an engine which does not reach its normal operating temperature. For instance, when the engine is extremely cold the lubricant does not flow freely and the engine may be subjected to greater wear.

The parameter with which the present invention deals in meeting the IID engine test is that of avoiding emulsion and/or foam build-up in an internal combustion engine. All engines generate or receive water. Typically the water is from the by-products of combustion, condensation within the engine when the weather is cold, or from any number of other means. When water finds its way into the crankcase the dissimilarity of the water and the oil allow emulsion formation. The water in an oil may approach 8% by weight of the oil. Many detergent materials or other additives are capable of forming an emulsion, and/or, foam when sufficient water is present an engine.

Ordinarily, the presence of small amounts of water in a crankcase is to be expected, and when the engine is operating at its intended temperature emulsion formation does not accumulate heavily as the emulsion is itself unstable at elevated operating temperatures.

However, when an engine is driven only for short periods of time and is shut off, foaming and/or emulsions may occur. It is possible that the ventilation lines to a crankcase will have emulsion, and/or foam blown up into the line when the engine is operating under such conditions, e.g. low temperature, short distance driving conditions.

The effect of an emulsion and/or foam reaching a recirculation line is that the resultant foam or emulsion may block the line. Thus the normal intended breathing mechanism for the crankcase no longer functions with various deleterious results. If the foam reaches a point in a gas circulation line where the engine temperature is not sufficient to dislodge the emulsion it may adversely affect the operation of the vehicle.

The first aspect of the present invention to be discussed is a butylene oxide containing polymer. Butylene oxide containing polymers are those which are formed from the butylene oxides, e.g. 1,2 or 2,3-butylene oxide, or tetrahydrofuran. Of the butylene oxide polymers, tetrahydrofuran based polymers are preferred in the present invention. The antiemulsion agents of the present invention may also be copolymers of butylene oxide. In particular, the copolymers may be of butylene oxide, and ethylene oxide and/or propylene oxide. It is desired in the present invention that the butylene oxide predominate in the molecule and thus it is preferred that the butylene oxide on a molar basis be present at about 50 mole percent, preferably 60 mole percent and most preferably 75 mole percent.

The overall molecular weight of the butylene oxide containing polymer of the present invention is typically from about 350 to about 3,000. In a preferred formulation of the present invention the butylene oxide polymer is of the formula $HO(CH_2CH_2CH_2CH_2O)$ wherein n is from 10 to 50, preferably 15 to 45, and most preferably 20 to 40. The remaining butylene oxide polymers would have the same values for n but have branched repeating units.

The preferred polymers of the present invention as previously noted are obtained from tetrahydrofuran and correspond to the linear formula for a butylene oxide polymer as given immediately above. A preferred source of the butylene oxide polymer is Terathane® polymer 2000.

If desired, the antiemulsion agents may be manufactured or purchased. If manufactured, the polymers may be prepared by any conventional method conforming to the molecular weight and other provisos given herein. As previously noted the preferred polymer is one of tetrahydrofuran.

The antiemulsion agents of the present invention are often prepared and added as a concentrate with various other components to a base oil as later described. The antiemulsion agents of the present invention are typically utilized such that the antiemulsion agent is present at about 50 to about 2,500 ppm, preferably about 100 to about 2,200 ppm, and most preferably about 150 to about 2,000 by weight of the finished oil formulation. The finished oil formulation contains the base oil and all other manner of additive materials normally found in a passenger car motor oil. The manner of addition of the antiemulsion polymer of the present invention to a concentrate or the motor oil is by simple direct mixing of the various components.

The next component to be discussed within the scope of the present invention is the base oil or oil of lubricating viscosity.

THE BASE OIL

The types of lubricating oils which may be utilized herein are described as being of a lubricating viscosity and may be based on natural oils, synthetic oils, or mixtures thereof. The lubricating oils are also a preferred diluent for use herein.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecyl-benzenes, tetradecylbenzenes, dinonylbenzenes, di-(2-ethylhexyl)-benzenes, etc.); polyphenyls (e.g., biphenyls, terphenyls, alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$-$C_8$ fatty acid esters, or the $C_{13}$ acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra(p-tert-butyl-phenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioxtyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil.

Refined oils are similar to the unrefined oils except they have been further treated in one or more purification steps to improve one or more properties. Many such purification techniques are known to those skilled in the art such as solvent extraction, secondary distillation, hydrotreating, hydrocracking, acid or base extraction, filtration, percolation, etc.

Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products. Most preferably, the oil used herein is a petroleum derived oil.

A further useful component herein is a hydrocarbon-soluble ashless dispersant.

The Hydrocarbon-Soluble Ashless Dispersant

The compositions of the present invention desirably also contain a minor amount of at least one hydrocarbon soluble ashless dispersant. The compounds useful as ashless dispersants generally are characterized by a "polar" group attached to a relatively high molecular weight hydrocarbon chain. The "polar" group generally contains one or more of the elements nitrogen, oxygen and phosphorus. The solubilizing chains are generally higher in molecular weight than those employed with the metallic types, but in some instances they may be quite similar.

In general, any of the ashless detergents which are known in the art for use in lubricants and fuels can be utilized in the compositions of the present invention.

In one embodiment of the present invention, the dispersant is selected from the group consisting of (i) at least one hydrocarbyl-substituted amine wherein the hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one $$-NH-$$

group, said acylating agent being linked to said amino compound through an imido, amido, amidine, or acyloxy ammonium linkage;

(iii) at least one nitrogen-containing condensate of a phenol, aldehyde and amino compound having at least one $$-NH-$$

group;

(iv) at least one ester of a substituted carboxylic acid;

(v) at least one polymeric dispersant;

(vi) at least one hydrocarbon substituted phenolic dispersant; and (vii) at least one oil soluble alkoxylated derivative of an alcohol, phenol or amine.

The Hydrocarbyl-Substituted Amine

The hydrocarbyl-substituted amines used in the compositions of this invention are well known to those of skill in the art and they are described in a number of patents. Among these are U.S. Pat. Nos. 3,275,554; 3,438,757; 3,454,555; 3,565,804; 3,755,433 and 3,822,209. These patents disclose suitable hydrocarbyl amines for use in the present invention including their method of preparation.

A typical hydrocarbyl amine has the general formula:

$$[AXN]_x[-N([-UN-]_a[-UQ]_b)]_yR^2_cH_{1+2y+ay-c} \quad \text{Formula I}$$

wherein A is hydrogen, a hydrocarbyl group of from 1 to about 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A and N to form a ring of from 5 to 6 annular members and up to 12 carbon atoms; U is an alkylene group of from 2 to 10 carbon atoms, any necessary hydrocarbons to accommodate the trivalent nitrogens are implied herein, $R^2$ is an aliphatic hydrocarbon of from about 30 to 400 carbon atoms; Q is a piperazine structure; a is an integer of from 0 to 10; b is an integer of from 0 to 1; a+2b is an integer of from 1 to 10; c is an integer of from about 1 to 5 and is an average in the range of 1 to 4, and equal to or less than the number of nitrogen atoms in the molecule; x is an integer of from 0 to 1; y is an integer of from about 0 to 1; and x+y is equal to 1.

In interpreting this formula, it is to be understood that the $R^2$ and H atoms are attached to the unsatisfied nitrogen valences within the brackets of the formula. Thus, for example, the formula includes sub-generic formulae wherein the R is attached to terminal nitrogens and isomeric subgeneric formula wherein it is attached to non-terminal nitrogen atoms. Nitrogen atoms not attached to an $R^2$ may bear a hydrogen or an AXN substituent.

The hydrocarbyl amines useful in this invention and embraced by the above formula include monoamines of the general formula:

$$AXNR^2 \qquad \text{Formula II}$$

Illustrative of such monoamines are the following:

poly(propylene)amine
N,N-dimethyl-n-poly(ethylene/propylene)amine (50:50 mole ratio of monomers)
poly(isobutene)amine
N,N-di(hydroxyethyl)-N-ply(isobutene)amine
poly(isobutene/1-butene/2-butene)amine (50:25:25 mole ratio of monomer)
N-(2-hydroxyethyl)-N-poly(isobutene)amine
N-(2-hydroxypropyl)-N-poly(isobutene)amine
N-poly(1-butene)-aniline
N-poly(isobutene)-morpholine Among the hydrocarbyl amines embraced by the general formula II as set forth above, are polyamines of the general formula:

$$-N([-UN-[_a[-UQ]_b)R^2{}_cH_{1+2y+ay-c} \qquad \text{Formula III}$$

Illustrative of such polyamines following:

N-poly(isobutene) ethylene diamine
N-poly(propylene) trimethylene diamine
N-poly(1-butene) diethylene triamine
N',N'-poly(isobutene) tetraethylene pentamine
N,N-dimethyl-N'-poly(propylene), 1,3-propylene diamine The hydrocarbyl substituted amines useful in the compositions of this invention include certain N-aminohydrocarbyl morpholines which are not embraced in the general Formula I above. These hydrocarbyl-substituted aminohydrocarbyl morpholines have the general formula:

$$R^2N(A)UM \qquad \text{Formula IV}$$

wherein $R^2$ is an aliphatic hydrocarbon group of from about 30 to about 400 carbons, A is hydrogen, hydrocarbyl of from 1 to 10 carbon atoms or hydroxy hydrocarbyl group of from 1 to 10 carbon atoms, U is an alkylene group of from 2 to 10 carbon atoms, and M is a morpholine structure. These hydrocarbyl-substituted aminohydrocarbyl morpholines as well as the polyamines described by Formula II are among the typical hydrocarbyl-substituted amines used in preparing compositions of this invention.

The Acylated Nitrogen-Containing Compounds

A number of acylated, nitrogen-containing compounds having a substituent of at least 10 aliphatic carbon atoms and made by reacting a carboxylic acid acylating agent with an amino compound are known to those skilled in the art. In such compositions the acylating agent is linked to the amino compound through an imido, amido, amidine or acyloxy ammonium linkage. The substituent of 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines having aliphatic substituents of up to about 30 carbon atoms.

A typical class of acylated amino compounds useful in the compositions of this invention are those made by reacting an acylating agent having an aliphatic substituent of at least 10 carbon atoms and a nitrogen compound characterized by the presence of at least one —NH— group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The aliphatic substituent in such acylating agents preferably averages at least about 30 or 50 and up to about 400 carbon atoms.

Illustrative hydrocarbon based groups containing at least ten carbon atoms are n-decyl, n-dodecyl, tetrapropenyl, n-octadecyl, oleyl, chlorooctadecyl, tri-icontanyl, etc. Generally, the hydrocarbon-based substituents are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The substituent can also be derived from the halogenated (e.g., chlorinated or brominated) analogs of such homo- or interpolymers. The substituent can, however, be made from other sources, such as monomeric high molecular weight alkenes (e.g., 1-tetra-contene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

As used in this specification and appended claims, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon group for every ten carbon atoms provided this non-hydrocarbon group does not significantly alter the predominantly hydrocarbon character of the group. Those skilled in the art will be aware of such groups, which include, for example, hydroxyl, halo (especially chloro and fluoro), alkoxyl, alkyl mercapto, alkyl sulfoxy, etc. Usually, however, the hydrocarbon-based substituents are purely hydrocarbyl and contain no such non-hydrocarbyl groups.

The hydrocarbon-based substituents are substantially saturated, that is, they contain no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of six or less carbon atoms for every ten carbon atoms in the substituent. Usually, however, the substituents contain no more than one such non-aliphatic group for every fifty carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than 30 carbon atoms are the following:

a mixture of poly(ethylene/propylene) groups of about 35 to about 70 carbon atoms a mixture of the oxidatively or mechanically degraded poly(ethylene/propylene) groups of about 35 to about 70 carbon atoms a mixture of poly(propylene/1-hexene) groups of about 80 to about 150 carbon atoms a mixture of poly(isobutene) groups having an average of 50 to 75 carbon atoms. A preferred source of the substituents are poly-(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeating units) isobutene repeating units of the configuration:

$$-C(CH_3)_2CH_2-$$

Exemplary of amino compounds useful in making these acylated compounds are the following:

(1) polyalkylene polyamines of the general formula:

$$(R^3)_2N[U-N(R^3)]_nR^3 \qquad \text{Formula V}$$

wherein $R^3$ is independently a hydrogen atom, a hydrocarbyl group or a hydroxy-substituted hydrocarbyl group containing up to about 30 carbon atoms, with proviso that at least one $R^3$ is a hydrogen atom, n is a whole number of 1 to 10 and U is a $C_{1-18}$ alkylene group, (2) heterocyclic-substituted polyamines including hydroxyalkyl-substituted polyamines wherein the polyamines are described above and the heterocyclic substituent is e.g., a piperazine, an imidazoline, a pyrimidine, a morpholine, etc., and (3) aromatic polyamines of the general formula:

$$Ar(NR^3{}_2)_y \qquad \text{Formula VI}$$

wherein Ar is a aromatic nucleus of 6 to about 20 carbon atoms, each R''' is as defined hereinabove and y is 2 to about 8. Specific examples of the polyalkylene polyamines (1) are ethylene diamine, tetra(ethylene)-pentamine, tri-(trimethylene)tetramine, 1,2-propylene diamine, etc. Specific examples of hydroxyalkyl-substituted polyamines include N-(2-hydroxyethyl) ethylene diamine, N,N¹-bis-(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl--(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763 and 4,234,435. A typical acylated nitrogen-containing compound of this class is that made by reacting a poly(isobutene)-substituted succinic anhydride acylating agent (e.g., anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene chloride. In view of the extensive disclosure of this type of acylated amino compound, further discussion of their nature and method of preparation is not needed here. The above-noted U.S. Patents are utilized for their disclosure of acylated amino compounds and their method of preparation.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the mono-carboxlyic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715.

Still another type of acylated nitrogen compound useful in this invention is the product of the reaction of a fatty monocarboxylic acid of about 12–30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12–30 carbon atoms. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chlorostearic acids. Branched chain fatty carboxylic acid-/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are utilized for their disclosure of fatty acid/polyamine condensates for their use in lubricating oil formulations.

The Nitrogen-Containing Condensates of Phenols, Aldehydes, and Amino Compounds The phenol/aldehyde/amino compound condensates useful as dispersants in the compositions of this invention include those generically referred to as Mannich condensates. Generally they are made by reacting simultaneously or sequentially at least one active hydrogen compound such as a hydrocarbon-substituted phenol (e.g., and alkyl phenol wherein the alkyl group has at least an average of about 12 to 400; preferably 30 up to about 400 carbon atoms), having at least one hydrogen atom bonded to an aromatic carbon, with at least one aldehyde or aldehyde-producing material (typically formaldehyde precursor) and at least one amino or polyamino compound having at least one NH group. The amino compounds include primary or secondary monoamines having hydrocarbon substituents of 1 to 30 carbon atoms or hydroxyl-substituted hydrocarbon substituents of 1 to about 30 carbon atoms. Another type of typical amino compound are the polyamines described during the discussion of the acylated nitrogen-containing compounds.

Exemplary mono-amines include methyl ethyl amine, methyl octadecyl amines, aniline, diethyl amine, diethanol amine, dipropyl amine and so forth. The following U.S. Patents contain extensive descriptions of Mannich condensates which can be used in making the compositions of this invention:

| U.S. PAT. Nos. | | |
|---|---|---|
| 2,459,112 | 3,413,347 | 3,558,743 |
| 2,962,442 | 3,442,808 | 3,586,629 |
| 2,984,550 | 3,448,047 | 3,591,598 |
| 3,036,003 | 3,454,497 | 3,600,372 |
| 3,166,516 | 3,459,661 | 3,634,515 |
| 3,236,770 | 3,461,172 | 3,649,229 |
| 3,355,270 | 3,493,520 | 3,697,574 |
| 3,368,972 | 3,539,633 | |

Condensates made from sulfur-containing reactants also can be used in the compositions of the present invention. Such sulfur-containing condensates are described in U.S. Pat. Nos. 3,368,972; 3,649,229; 3,600,372; 3,649,659 and 3,741,896. These patents also disclose sulfur-containing Mannich condensates. Generally the condensates used in making compositions of this invention are made from a phenol bearing an alkyl substituent of about 6 to about 400 carbon atoms, more typically, 30 to about 250 carbon atoms. These typical condensates are made from formaldehyde or $C_{2-7}$ aliphatic aldehyde and an amino compound such as those used in making the acylated nitrogen-containing compounds described under (ii).

These preferred condensates are prepared by reacting about one molar portion of phenolic compound with about 1 to about 2 molar portions of aldehyde and about 1 to about 5 equivalent portions of amino compound (an equivalent of amino compound is its molecular weight divided by the number of =NH groups present). The conditions under which such condensation reactions are carried out are well known to those skilled in the art as evidenced by the above-noted patents. Therefore, these patents are also incorporated by reference for their disclosures relating to reaction conditions.

A particularly preferred class of nitrogen-containing condensation products for use in the present invention are those made by a "2-step process" as disclosed in commonly assigned U.S. Pat. No. 4,273,891 issued Jun. 16, 1981. Briefly, these nitrogen-containing condensates are made by (1) reacting at least one hydroxy aromatic compound containing an aliphatic-based or cycloaliphatic-based substituent which has at least about 30 carbon atoms and up to about 400 carbon atoms with a lower aliphatic $C_{1-7}$ aldehyde or reversible polymer thereof in the presence of an alkaline reagent, such as an alkali metal hydroxide, at a temperature up to about 150° C.; (2) substantially neutralizing the intermediate reaction mixture thus formed; and (3) reacting the neutralized intermediate with at least one compound which contains an amino group having at least one —NH— group.

More preferably, these 2-step condensates are made from (a) phenols bearing a hydrocarbon-based substituent having about 30 to about 250 carbon atoms, said substituent being derived from a polymer of propylene, 1-butene, 2-butene, or isobutene and (b) formaldehyde, or reversible polymer thereof, (e.g., trioxane, paraformaldehyde) or functional equivalent thereof, (e.g., methylol) and (c) an alkylene polyamine such as ethylene polyamines having between 2 and 10 nitrogen atoms. Further details as to this preferred class of condensates can be found in the hereinabove noted U.S. Pat. No. 4,273,891, which is hereby incorporated by reference, for its disclosures relating to 2-step condensates.

The Esters of Substituted Carboxylic Acids

The esters useful as detergents/dispersants in this invention are derivatives of substituted carboxylic acids in which the substituent is a substantially aliphatic, substantially saturated hydrocarbon-based group containing at least about 30 (preferably about 50 to about 750) aliphatic carbon atoms. As used herein, the term "hydrocarbon-based group" denotes a group having a carbon atom directly attached to the remainder of the molecule and having predominantly hydrocarbon character within the context of this invention. Such groups include the following:

(1) Hydrocarbon groups; that is, aliphatic groups, aromatic-andalicyclic-substituted aliphatic groups, and the like, of the type know to those skilled in the art.

(2) Substituted hydrocarbon groups; that is, groups containing non-hydrocarbon substituents which, in the context of this invention, do not alter the predominantly hydrocarbon character of the group. Those skilled in the art will be aware of suitable substituents; ex-amples are halo, nitro, hydroxy, alkoxy, carbalkoxy and alkylthio.

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

The substituted carboxylic acids (and derivatives thereof including esters, amides and imides) are normally prepared by the alkylation of an unsaturated acid, or a derivative thereof such as an anhydride, ester, amide or imide, with a source of the desired hydrocarbon-based group. Suitable unsaturated acids and derivatives thereof include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid and 2-pentene-1,3,5-tricarboxylic acid. Particularly preferred are the unsaturated dicarboxylic acids and their derivatives, especially maleic acid, fumaric acid and maleic anhydride.

Suitable alkylating agents include homopolymers and interpolymers of polymerizable olefin monomers containing from about 2 to about 10 and usually from about 2 to about 6 carbon atoms, and polar substituent-containing derivatives thereof. Such polymers are substantially saturated (i.e., they contain no more than about 5% olefinic linkages) and substantially aliphatic (i.e., they contain at least about 80% and preferably at least about 95% by weight of units derived from aliphatic mono-olefins). Illustrative monomers which may be used to produce such polymers are ethylene, propylene, 1-butene, 2-butene, isobutene, 1-octene and 1-decene. Any unsaturated units may be derived from conjugated dienes such as 1,3-butadiene and isoprene; non-conjugated dienes such as 1,4-hexadiene, 1,4-cyclohexadiene, 5-ethylidene-2-norbornene and 1,6-octadiene: and trienes such as 1-iso-propylidene-3a,4,7,7a-tetrahydroindene, 1-isopropylidene-dicyclopentadiene and 2-(2-methylene-4-methyl-3-pentenyl) [2.2.1]bicyclo-5-heptene.

A first preferred class of polymers comprises those of terminal olefins such as propylene, 1-butene, isobutene and 1-hexene. Especially preferred within this class are polybutenes comprising predominantly isobutene units. A second preferred class comprises terpolymers of ethylene, a $c_{3-8}$ alpha-monoolefin and a polyene selected from the group consisting of non-conjugated dienes (which are especially preferred) and trienes. Illustrative of these terpolyers is "Ortholeum 2052" manufactured by E. I duPont de Nemours & Company, which is a terpolymer containing about 48 mole percent ethylene groups, 48 mole percent propylene groups and 4 mole percent 1,4-hexadiene groups and having an inherent viscosity of 1.35 (8.2 grams of polymer in 10 ml. of carbon tetrachloride at 30° C.).

Methods for the preparation of the substituted carboxylic acids and derivatives thereof are well known in the art and need not be described in detail. Reference is made, for example, to U.S. Pat. Nos. 3,272,746; 3,522,179; and 4,234,435 which are incorporated by reference herein. The mole ratio of the polymer to the unsaturated acid or derivative thereof may be equal to, greater than or less than 1, depending on the type of product desired.

The esters are those of the above-described succinic acids with hydroxy compounds which may be aliphatic compounds such as monohydric and polyhydric alcohols or aromatic compounds such as phenols and naphthols. The aromatic hydroxy compounds from which the esters of this invention may be derived are illustrated by the following specific examples: phenol, beta-naphthol, alpha-naphthol, cresol, resorcinol, catechol, p,p'di-hydroxybiphenyl, 2-chlorophenol, 2,4-dibutylphenol, propene tetramer-substituted phenol, didodecylphenol, 4,4'-methylene-bis-phenol, alpha-decyl-beta-naphthol, polyisobutene (molecular weight of 1000)-substituted phenol, the condensation product of heptylphenol with 0.5 mole of formaldehyde, the condensation product of octyl-phenol with acetone, di(hydroxyphenyl)-oxide, di(hydroxy-phenyl)sulfide, di(hydroxyphenyl)disulfide, and 4-cyclo-hexylphenol. Phenol and alkylated phenols having up to three alkyl substituents are preferred. Each of the alkyl substituents may contain 100 or more carbon atoms.

The alcohols from which the esters may be derived preferably contain up to about 40 aliphatic carbon atoms. They may be monohydric alcohols such as methanols, ethanol, isooctanol, dodecanol, cyclohexanol, cyclo-pentanol, behenyl alcohol, hexatriacontanol, neopentyl alcohol, isobutyl alcohol, benzyl alcohol, beta-phenyl-ethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, secpentyl alcohol, tertbutyl alcohol, 5-bromo-dodecanol, nitro-octadecanol and dioleate of glycerol. The poly-hydric alcohols preferably contain from 2 to about 10 hydroxy radicals. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, penacol, erythritol, arabitol, sorbitol, mannitol, 1,2-cyclo-hexanediol, and xylene glycol. Carbohydrates such as sugars, starches, cellulose, etc., likewise may yield the esters of this invention. The carbohydrates may be exemplified by a glucose, fructose, sucrose, rhamnose, mannose, glyceraldehyde, and galactose.

An especially preferred class of polyhydric alcohols are those having at least three hydroxy radicals, some of which have been esterified with a monocarboxylic acid having from about 8 to about 30 carbon atoms, such as octanoic acid, oleic acid, stearic acid, linoleic acid, dodecanoic acid, or tall oil acid. Examples of such partially esterified polyhydric alcohols are the mono-oleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol, an oleyl alcohol. Still another class of the alcohols capable of yielding the esters of this invention comprise the ether-alcohols and amino-alcohols including, for example, the oxyalkylene-, oxyarylene-, amino-alkylene-, and amino-arylene-substituted alcohols having one or more oxyalkylene, amino-alkylene or amino-arylene oxy-arylene radicals. They are exemplified by Cellosolve, carbitol, phenoxyethanol, heptylphenyl-(oxypropylene)$_6$-H, octyl-(oxyethylene)$_{30}$-H, phenyl-(oxyoctylene)2-H, mono(heptylphenyl-oxypropylene)-substituted glycerol, poly(styrene oxide), aminoethanol, 3-amino ethyl-pentanol, di(hydroxyethyl) amine, p-amino-phenol, tri(hydroxypropyl)amine, N-hydroxyethyl ethylene diamine, N,N,N',N'-tetrahydroxy-trimethylene diamine, and the like. For the most part, the ether-alcohols having up to about 150 oxyalkylene radicals in which the alkylene radical contains from 1 to about 8 carbon atoms are preferred.

The esters may be di-esters of succinic acids or acidic esters, i.e., partially esterified polyhydric alcohols or phenols, i.e., esters having free alcoholic or phenolic hydroxyl radicals. Mixtures of the above-illustrated esters likewise are contemplated within the scope of the invention.

The esters may be prepared by one of several methods. The method which is preferred because of convenience and superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C.

The water formed as a by-product is removed by distillation as the esterification proceeds. A solvent may be used in the esterification to facilitate mixing and temperature control. It also facilitates the removal of water from the reaction mixture. The useful solvents include xylene, toluene, diphenyl ether, chlorobenzene, and mineral oil.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid radicals is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl radicals of the alcohol is esterified with one of the two acid radicals of the succinic acid. Thus, the maximum proportion of the succinic acid to be used with a polyhydric alcohol is determined by the number of hydroxyl groups present in the molecule of the hydroxy reactant. For the purposes of this invention, it has been found tha esters obtained by the reaction of equimolar amounts of the succinic acid reactant and hydroxy reactant have superior properties and are therefore preferred.

In some instances, it is advantageous to carry out the esterification in the presence of a catalyst such as sulfuric acid, pyridine hydrochloride, hydrochloric acid, benzenesulfonic acid, p-toluenesulfonic acid, phosphoric acid, or any other known esterification catalyst. The amount of the catalyst in the reaction may be as little as 0.01% (by weight of the reaction mixture), more often from about 0.1% to about 5%.

The esters of this invention likewise may be obtained by the reaction of a substituted succinic acid or anhydride with an epoxide or a mixture of a epoxide and water. Such reaction is similar to one involving the acid or anhydride with a glycol. For instance, the product may be prepared by the reaction of a substituted succinic acid with one mole of ethylene oxide. Similarly, the product may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soya bean oil, methyl ester of 9,10-epoxy-stearic acid, and butadiene monoepoxide. For the most part, the epoxides are the alkylene oxides in which the alkylene radical has from 2 to about 8 carbon atoms; or the epoxidized fatty acid esters in which the fatty acid radical has up to about 30 carbon atoms and the ester radical is derived from a lower alcohol having up to about 8 carbon atoms.

In lieu of the succinic acid or anhydride, a lactone acid or a substituted succinic acid halide may be used in the processes illustrated above for preparing the esters of this invention. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorous tribromide, phosphorus pentechloride, or thionyl chloride. These and other methods of preparing the succinic compounds are well known in the art and need not be illustrated in further detail here.

Still other methods of preparing the esters useful in this invention are available. For instance, the esters may be obtained by the reaction of maleic acid or anhydride with an alcohol such as is illustrated above to form a mono- or di-ester of maleic acid and then the reaction of this ester with an olefin or a chlorinated hydrocarbon such as is illustrated above. They may also be obtained by first esterifying itaconic anhydride or acid and subsequently reacting the ester intermediate with an olefin or a chlorinated hydrocarbon under conditions similar to those described hereinabove.

The Polymeric Dispersants

A large number of different types of polymeric dispersants have been suggested as useful in lubricating oil formulations, and such polymeric dispersants are useful in the compositions of the present invention. Often, such additives have been described as being useful in lubricating formulations as viscosity index improvers with dispersing characteristics. The polymeric dispersants generally are polymers or copolymers having a long carbon chain and containing "polar" compounds to impart the dispersancy characteristics. Polar groups which may be included include amines, amides, imines, imides, hydroxyl, ether, etc. For example, the polymeric dispersants may be copolymers of methacrylates or acrylates containing additional polar groups, ethylene-propylene copolymers containing polar groups or vinyl acetatefumaric acid ester copolymers.

Many such polymeric dispersants have been described in the prior art, and it is not believed necessary to list in detail the various types. The following are examples of patents describing polymeric dispersants. U.S. Pat. No. 4,402,844 describes nitrogen-containing copolymers prepared by the reaction of lithiated hydrogenated conjugated dienemonovinylarene copolymers with substituted aminolactans. U.S. Pat. No. 3,356,763 describes a process for producing block copolymers of dienes such as 1,3-butadiene and vinyl aromatic hydrocarbons such as ethyl styrenes. U.S. Pat. No. 3,891,721 describes block polymers of styrene-butadiene-2-vinyl pyridine.

A number of the polymeric dispersants may be prepared by the grafting polar monomers to polyolefinic backbones. For example, U.S. Pat. Nos. 3,687,849 and 3,687,905 describe the use of maleic anhydrides as a graft monomer to a polyolefinic backbone. Maleic acid or anhydride is particularly desirable as a graft monomer because this monomer is relatively inexpensive, provides an economical route to the incorporation of dispersant nitrogen compounds into polymers by further reaction of the carboxyl groups of the maleic acid or anhydride with, for example, nitrogen compounds or hydroxy compounds. U.S. Pat. No. 4,160,739 describes graft copolymers obtained by the grafting of a monomer system comprising maleic acid or anhydride and at least one other different monomer which is addition copolymerizable therewith, the grafted monomer system then being post-reacted with a polyamine. The monomers which are copolymerizable with maleic acid or anhydride are any alpha, beta-monoethylenically unsaturated monomers which are sufficiently soluble in the reaction medium and reactive towards maleic acid or anhydride so that substantially larger amounts of maleic acid or anhydride can be incorporated into the grafted polymeric product. Accordingly, suitable monomers include the esters, amides and nitriles of acrylic and methacrylic acid, and monomers containing no free acid groups. The inclusion of heterocyclic monomers into graft polymers is described by a process which comprises a first step of graft polymerizing an alkyl ester of acrylic acid or methacrylic acid, alone or an combination with styrene, onto a backbone copolymer which is a hydrogenated block copolymer of styrene and a conjugated diene having 4 to 6 carbon atoms to form a first graft polymer. In the second step, a polymerizable hetero-cyclic monomer, alone or in combination with a hydro-phobizing vinyl ester is co-polymerized onto the first graft copolymer to form a second graft copolymer.

Other patents describing graft polymers useful as dispersants in this invention include U.S. Pat. Nos. 3,243,481; 3,475,514; 3,723,575; 4,026,167; 4,085,055; 4,181,618; and 4,476,283.

Another class of polymeric dispersant useful in the compositions of the invention are the so-called "star" polymers and copolymers. Such polymers are described in, for example, U.S. Pat. Nos. 4,346,193, 4,141,847, 4,358,565, 4,409,120 and 4,077,893. All of the above patents relating to polymeric dispersants are utilized for their disclosure of suitable polymeric dispersants which can be utilized in this invention.

The Hydrocarbon-Substituted Phenolic Dispersant

The hydrocarbon-substituted phenolic dispersants useful in the present invention include the hydrocarbon-substituted phenolic compounds wherein the hydrocarbon substituents have a molecular weight which is sufficient to render the phenolic compound oil soluble. Generally, the hydrocarbon substituent will be a substantially saturated, hydrocarbon-based group of at least about 30 carbon atoms. The phenolic compounds may be represented generally by the following formula:

$$(R)_a—Ar—(OH)_b \qquad \text{Formula VII}$$

wherein R is a substantially saturated hydrocarbon-based substituent having an average of from about 30 to about 400 aliphatic carbon atoms, and a and b are each, 1, 2 or 3. Ar is an aromatic moiety such as a benzene nucleus naphthalene nucleus or linked benzene nuclei. Optionally, the above phenates as represented by Formula VII may contain other substituents such as lower alkyl groups, lower alkoxyl, nitro, amino, and halo groups. Preferred examples of optional substituents are the nitro and amino groups.

The substantially saturated hydrocarbon-based group R in Formula VII may contain up to about 750 aliphatic carbon atoms although it usually has a maximum of an average of about 400 carbon atoms. In some instances R has a minimum of about 50 carbon atoms. As noted, the phenolic compounds may contain more than one R group for each aromatic nucleus in the aromatic moiety Ar.

Generally, the hydrocarbon-based groups R are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such homo- or interpolymers. The R groups can, however, be made from other sources, such as monomeric high molecular weight alkenes (e.g. 1-tetra-contene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greases) and other sources known to those skilled in the art. Any unsaturation in the R groups may be reduced or eliminated by hydrogenation according to procedures known in the art before the nitration step described hereafter.

Specific examples of the substantially saturated hydrocarbon-based R groups are the following:

- a tetracontanyl group
- a henpentacontanyl group
- a mixture of poly(ethylene/propylene) groups of about 35 to about 70 carbon atoms
- a mixture of the oxidatively or mechanically degraded poly-(ethylene/propylene) groups of about 35 to about 70 carbon atoms
- a mixture of poly(propylene/1-hexene) groups of about 80 to about 150 carbon atoms
- a mixture of poly(isobutene) groups having between 20 and 32 carbon atoms
- a mixture of poly(isobutene) groups having an average of 50 to 75 carbon atoms.

A preferred source of the group R are poly-(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeat units) isobutene repeating units of the configuration.

$$-C(CH_3)_2CH_2-$$

The attachment of the hydrocarbon-based group R to the aromatic moiety Ar of the amino phenols of this invention can be accomplished by a number of techniques well known to those skilled in the art.

In one preferred embodiment, the phenolic dispersants useful in the present invention are hydrocarbon-substituted nitro phenols as represented by Formula VII wherein the optional substituent is one or more nitro groups. The nitro phenols can be conveniently prepared by nitrating appropriate phenols, and typically, the nitro phenols are formed by nitration of alkyl phenols having an alkyl group of at least about 30 and preferably about 50 carbon atoms. The preparation of a number of hydrocarbon-substituted nitro phenols useful in the present invention is described in U.S. Pat. No. 4,347,148.

In another preferred embodiment, the hydrocarbon-substituted phenol dispersants useful in the present invention are hydrocarbon-substituted amino phenols such as represented by Formula VII wherein the optional substituent is one or more amino groups. These amino phenols can conveniently be prepared by nitrating an appropriate hydroxy aromatic compound as described above and there after reducing the nitro groups to amino groups. Typically, the useful amino phenols are formed by nitration and reduction of alkyl phenols having an alkyl or alkenyl group of at least about 30 and preferably about 50 carbon atoms. The preparation of a large number of hydrocarbon-substituted amino phenols useful as dispersants in the present invention is described in U.S. Pat. No. 4,320,021.

The Oil-Soluble Alkoxylated Derivatives of Alcohols, Phenols or Amines

Also useful as dispersants in the compositions of the present invention are oil-soluble alkoxylated derivatives of alcohols, phenols and amines. A wide variety of such derivatives can be utilized as long as the derivatives are oil soluble or oil dispersible.

As is well known to those skilled in the art, the water-insolubility characteristics of the alkoxylated derivatives can be controlled by selection of the alcohol or phenols and amines, selection of the particular alkoxy reactant, and by selection of the amount of alkoxy reactant which is reacted with the alcohols, phenols and amines. The alcohols which are utilized to prepare the alkoxylated derivatives are hydrocarbon based alcohols while the amines are hydrocarbyl-substituted amines such as, for example, the hydrocarbyl-substituted amines described above as dispersant (i). The phenols may be phenols or hydrocarbon-substituted phenols and the hydrocarbon substituent may contain as few as 1 carbon atom.

The alkoxylated derivatives are obtained by reacting the alcohol, phenol or amine with an epoxide or a mixture of an epoxide and water. For example, the derivative may be prepared by the reaction of the alcohol, phenol or amine with an equal molar amount or an excess of ethylene oxide. Other epoxides which can be reacted with the alcohol, phenol or amine include, for example, propylene oxide, styrene oxide, 1,2-butylene oxide, 2,3-butylene oxide, epichlorohydrin, cyclohexene oxide, 1,2-octylene oxide, etc. Preferably, the epoxides are the alkylene oxides in which the alkylene group has from about 2 to about 8 carbon atoms. As mentioned above, it is desirable and preferred that the amount of alkylene oxide reacted with the alcohol, phenol or amine be insufficient to render the derivative water-soluble.

The following are examples of commercially available alkylene oxide derivatives which may be utilized as dispersants in the compositions of the present invention: Ethomeen S/12, tertiary amines ethylene oxide condensation products of the primary fatty amines (HLB, 4.15; Armak Industries); Plurafac A-24, an oxyethylated straight-chain alcohol available from BASF Wyandotte Industries (HLB 5.0); etc. Other suitable oil-soluble alkoxylated derivatives of alcohols, phenols and amines will be readily apparent to those skilled in the art.

The following specific examples illustrate the preparation of exemplary dispersants useful in the compositions of this invention.

EXAMPLE A-1

A mixture of 1500 parts of chlorinated poly-(isobutene) having a molecular weight of about 950 and a chlorine content of 5.6%, 285 parts of an alkylene polyamine having an average composition corresponding stoichiometrically to tetraethylene pentamine and 1200 parts of benzene is heated to reflux. The temperature of the mixture is then slowly increased over a 4-hour period to 170° C. while benzene is removed. The cooled mixture is diluted with an equal volume of mixed hexanes and absolute ethanol (1:1). The mixture is heated to reflux and ⅓ volume of 10% aqueous sodium carbonate is added to the mixture. After stirring, the mixture is allowed to cool and phase separate. The organic phase is washed with water and stripped to provide the desired polyisobutenyl polyamine having a nitrogen content of 4.5% by weight.

EXAMPLE A-2

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7% by weight.

EXAMPLE A-3

To 1,133 parts of commercial diethylene triamine heated at 110°-150° C. is slowly added 6820 parts of isostearic acid over a period of two hours. The mixture is held at 150° C. for one hour and then heated to 180° C. over an additional hour. Finally, the mixture is heated to 205° C. over 0.5 hour; throughout this heating, the mixture is blown with nitrogen to remove volatiles. The mixture is held at 205°-230° C. for a total of 11.5 hours and the stripped at 230° C./20 torr (2.65KPa)

to provide the desired acylated polyamine as residue containing 6.2% nitrogen by weight.

EXAMPLE A-4

To a mixture of 50 parts of a polypropyl-substituted phenol (having a molecular weight of about 900, vapor phase osmometry), 500 parts of mineral oil (a solvent refined paraffinic oil having a viscosity of 100 SUS at 100° F.) and 130 parts of 9.5% aqueous dimethylamine solution (equivalent to 12 parts amine) is added dropwise, over an hour, 22 parts of a 37% aqueous solution of formaldehyde (corresponding to 8 parts aldehyde). During the addition, the reaction temperature is slowly increased to 100° C. and held at that point for three hours while the mixture is blown with nitrogen. To the cooled reaction mixture is added 100 parts toluene and 50 parts mixed butyl alcohols. The organic phase is washed three times with water until neutral to litmus paper and the organic phase filtered and stripped to 200° C./5-10 (0.66 −1.33KPa) torr. The residue is an oil solution of the final product containing 0.45% nitrogen by weight.

EXAMPLE A-5

A mixture of 140 parts of a mineral oil, 174 parts of a poly(isobutene)-substituted succinic anhydride (molecular weight 1000) having a saponification number of 105 and 23 parts of isostearic acid is prepared at 90° C. To this mixture there is added 17.6 parts of a mixture of polyalkylene amines having an overall composition corresponding to that of tetraethylene pentamine at 80°-100° C. throughout a period of 1.3 hours. The reaction is exothermic. The mixture is blown at 225° C. with nitrogen at a rate of 5 pounds (2.27 Kg) per hour for 3 hours whereupon 47 parts of an aqueous distillate is obtained. The mixture is dried at 225° C. for 1 hour, cooled to 100° C. and filtered to provide the desired final product in oil solution.

EXAMPLE A-6

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is mixed at 240°-250° C./30 mm (4 KPa) for 12 hours. The residue is a mixture of the esters resulting from the esterification of one and both hydroxy radicals of the glycol. It has a saponification number of 101 and an alcoholic hydroxyl content of 0.2% by weight.

EXAMPLE A-7

The dimethyl ester of the substantially hydrocarbon-substituted succinic anhydride of Example A-2 is prepared by heating a mixture of 2185 grams of the anhydride, 480 grams of methanol, and 1000 cc. of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm (8 KPa) to rid it of volatile components. The residue is the defined dimethyl ester.

EXAMPLE A-8

A carboxylic acid ester is prepared by slowly adding 3240 parts of a high molecular weight carboxylic acid (prepared by reacting chlorinated polyisobutylene and acrylic acid in a 1:1 equivalent ratio and having an average molecular weight of 982) to a mixture of 200 parts of sorbitol and 100 parts of diluent oil over a 1.5-hour period while maintaining a temperature of 115°-125° C. Then 400 parts of additional diluent oil are added and the mixture is maintained at about 195°-205° C. for 16 hours while blowing the mixture with nitrogen. An additional 755 parts of oil are then added, the mixture cooled to 140° C., and filtered. The filtrate is an oil solution of the desired ester.

EXAMPLE A-9

An ester is prepared by heating 658 parts of a carboxylic acid having an average molecular weight of 1018 (prepared by reacting chlorinated polyisobutene with acrylic acid) with 22 parts of pentaerythritol while maintaining a temperature of about 180°-205° C. for about 18 hours during which time nitrogen is blown through the mixture. The mixture is then filtered and the filtrate is the desired ester.

EXAMPLE A-10

To a mixture comprising 408 parts of pentaerythritol and 1100 parts oil heated to 120° C., there is slowly added 2946 parts of the acid of Example A-9 which has been preheated to 120° C., 225 parts of xylene, and 95 parts of diethylene glycol dimethylether. The resulting mixture is heated at 195°-205° C., under a nitrogen atmosphere and reflux conditions for eleven hours, stripped to 140° C. at 22 mm (2.92 KPa) (Hg) pressure, and filtered. The filtrate comprises the desired ester. It is diluted to a total oil content of 40%.

THE ALKALI OR ALKALINE EARTH METAL DETERGENT

A commonly utilized material in a lubricant composition is a detergent. Typically the detergent is an anionic material which contains a long oleophillic portion of the molecule and a relatively concentrated anionic or oleophobic portion to the molecule.

Typically, the detergent material is one which is obtained as a hydrocarbyl-substituted benzene or toluene sulfonic acid which is reacted to give a sodium, calcium or magnesium detergent. The detergent material is often typically overbased by blowing carbondioxide through the molecule. The overbased components utilized herein are any of those materials typically utilized for lubricating oils or greases. The anion of the overbased component is typically a sulfonate, phenate, carboxylate, phosphate or similar material. Especially preferred herein are the anionic portions which are sulfonates. Typically the useful sulfonates will be mono- or di-hydrocarbyl substituted aromatic compounds. Such materials are tyically obtained from the by-product of detergent manufacture. The products are conveniently mono- or di-sulfonated and the hydrocarbyl substituted portion of the aromatic compound are typically alkyls containing about to 30, preferably about 14 to 28 carbon atoms.

The cationic portion of the overbased material is typically an alkali metal or alkaline earth metal. The commonly used alkali metals are lithium, potassium and sodium, with sodium being preferred. The alkaline earth metal components typically utilized are magnesium, calcium and barium with calcium and magnesium being the preferred materials.

The overbasing is accomplished utilizing an alkaline earth metal or alkali metal hydroxide. The overbasing is accomplished by utilizing typically any acid which may be bubbled through the component to be overbased. The preferred acidic material for overbasing the components of the present invention is carbon dioxide as it provides the source of carbonate in the product. As it has been noted that the present invention utilizes conventionally obtained overbased materials, no more is stated within this regard.

The preferred overbasing cation is sodium, calcium or magnesium, preferably an overbased sodium sulfonate.

The overbasing is generally done such that the metal ratio is from about 1.05:1 to about 50:1, preferably 2:1 to about 30:1 and most preferably from about 4:1 to about 25:1. The metal ratio is that ratio of metallic ions on an equivalent basis to the anionic portion of the overbased material.

THE ZINC DIALKYLDITHIOPHOSPHATE

Anti-wear agents that are particularly useful in the compositions of the invention are those obtained from a phosphorus acid of the formula (R'O)2PSSH, wherein each R' is independently a hydrocarbon-based group, or the phosphorus acid precursors thereof with at least one phosphite of the formula $(R''O)_3P$,R'' is a hydrocarbon-based group, under reaction conditions at a temperature of about 50° C. to about 200° C. R' is preferably an alkyl group of about 3 to about 50 carbon atoms, and R'' is preferably aromatic. The salt is preferably a zinc salt, but can be a mixed salt of at least one of said phosphorus acids and at least one carboxylic acid. These anti-wear agents are described more fully in U.S. Pat. No. 4,263,150, which is incorporated herein by reference. These anti-wear agents as well as the anti-wear agents referred to above can be provided in the compositions of the invention at levels of about 0.1% to about 5%, preferably about 0.25% to about 1% by weight based on the total weight of said fluid compositions.

THE ANTIOXIDANT

The present invention also includes the presence of various oxidation inhibitors such as those disclosed in U.S. Pat. No. 4,798,684 issued Jan. 17, 1989 to Salomon. Such additional antioxidants include additional oxidation inhibitors that are particularly useful in the fluid compositions of the invention are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamates (e.g., zinc dithiocarbamates). These oxidation inhibitors as well as the oxidation inhibitors discussed above are preferably present in the fluids of the invention at levels of about 0.025% to about 5%, more preferably about 0.1 to about 2% by weight based on the total weight of such compositions. The anti-oxidant may also be a metallic compound such as an oil soluble or oil dispersible copper compound. Such antioxidants are typically dialkyldithiophosphates, oleates or other soluble copper salts. The copper is used at 50 to 250, preferably 80 to 200 ppm based on the weight of the lubricant composition.

VISCOSITY IMPROVERS

Various materials may be included in motor oils to improve the viscosity characteristics thereof. Any of the commonly utilized viscosity improving agents used in the industry may be used herein. Typically, the most useful viscosity improvers are styrene-isoprene, or styrenebutadiene based polymers. These polymers typically have a molecular weight of from 50,000 to 200,00 and are utilized at 3 to 15% by weight of the lubricating oil composition.

The purpose of the viscosity improver is to maintain the viscosity of the oil at a relatively constant viscosity over all operating temperatures.

ADDITIONAL INGREDIENTS

The rust-inhibitors that are particularly useful in the compositions of the invention are the alkenyl succinic acids, anhydrides and esters, preferably the tetrapropehyl succinic acids, acid/esters and mixtures thereof; metal (preferably calcium and barium) sulfonates; the amine phosphates; and the imidazolines. These rustinhibitors are preferably present at levels of about 0.01% to about 5%, preferably about 0.02% to about 1% by weight base on the total weight of the product.

Pour point depressants may be included in the compositions described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. Publishers, Cleveland, Ohio 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation, and their uses are described in U.S. Pat. Nos. 2,387,501; 2,015,748; 2,655,479; 1,815,022; 2,191,498; 2,666,746; 2,721,877; 2,721,878 and 3,250,715 which are hereby incorporated by reference for their relevant disclosures.

What follows is an Example of the present invention.

EXAMPLE I

A polymer is made by reacting 432 parts of tetrahydrofuran and 174 parts of propylene oxide. The reaction is conducted by adding the tetrahydrofuran and the propylene oxide to a suitable reaction vessel. Antimony pentachloride is added at two parts to catalyze the polymer formation. An exotherm of about 15° C. occurred.

The antimony pentachloride catalyst is added again and an exotherm is observed. The procedure for adding the antimony pentachloride is repeated an additional three times or until no further exotherm is observed.

Water is added to the reaction mixture in 20 parts and the solids are separated out. The product is then filtered and stripped to give a viscous liquid.

EXAMPLE II

Terthane 2000 is obtained. Terthane 2000 is a straight chain butylene oxide polymer having a molecular weight of about 2000.

EXAMPLE III

A 1:1 weight mixture of the active ingredient of Example I and Example II is obtained.

EXAMPLE IV

A lubricating composition is obtained containing the following components:

| | |
|---|---|
| Base stock lubricating oil | 82 parts |
| Zinc dialkyldithiophosphate | 1 part |
| Viscosity improver | 8 parts |
| Dispersant of Example A-1 | 6 parts |
| Sodium overbased alkylbenzenesulfonate wherein the alkyl group averages 22 carbon atoms and the metal ratio is 20. | 1.5 parts |
| Sulfur coupled phenol | 1 part |
| Dinonyldiphenyl amine | 0.5 part |

The components described above are combined and there is added thereto 1000 ppm per part of: The antiemulsion agent of Example I, or II, or III. The compositions function as lubricants with little or no observed emulsion formation under engine operating conditions.

EXAMPLE V

A field test is conducted for emulsion formation. This test is also known as the Aunt Minnie test, euphemistically the aunt who only uses the motor vehicle to go to worship or to the grocery store once a week. The vehicles are obtained and the relevant parts for the test are cleaned and any existing conditions in the engine are noted.

The engines are reassembled and the vehicles are then filled with a lubricant comparable to that of Example IV while a comparison test is conducted utilizing the same lubricant but without the antiemulsion agent of the present invention. The vehicles are driven in city traffic over a course of 4 miles every fourth hour with the driving time for each test of from 10 to 15 minutes at speeds of less than 55 km/hour. The test is conducted under winter driving conditions in the Midwestern United States at a latitude of approximately 42 degrees north during the months of December through March.

The vehicles are periodically disassembled and the enmulsion and/or foaming characteristics of the oil are noted. The vehicles containing the antifoam/antiemulsion additive of the present invention show significantly less emulsion than do the comparative vehicles.

The compositions of the present invention show a significant improvement under Aunt Minnie field conditions over compositions not containing the antiemulsion/antifoam agent. Thus the invention gives an antiemulsion/antifoam benefit. Additionally, in a IID Engine test the lubricants perform such that crankcase pressures are maintained within a desirable range because the ventilation system is not blocked by foam and/or emulsion.

What is claimed is:

1. A crankcase lubricating oil composition containing as an antiemulsion agent an effective amount of about 50 ppm to about 2,500 ppm by weight of the composition of a butylene oxide containing polymer.

2. The composition of claim 1 wherein the polymer is a copolymer.

3. The composition of claim 2 wherein the copolymer is a copolymer of a butylene oxide and ethylene oxide or propylene oxide.

4. The composition of claim 1 wherein a dispersant is present.

5. The composition of claim 4 wherein the dispersant is present at a level of at least about 1% by weight of the composition.

6. The composition of claim 1 wherein the butylene oxide containing polymer is a polymer or copolymer of:

$$HO(CH_2CH_2CH_2CH_2O)_nH$$

where n is from about 10 to about 50.

7. The composition of claim 1 additionally containing at least one of a sodium, calcium or magnesium detergent.

8. The composition of claim 1 wherein the antiemulsion agent is present in a sufficient amount to retard foam formation.

9. The composition of claim 1 wherein the butylene oxide containing polymer is obtained by homopolymerizing a source of butylene oxide and further reacting the homopolymer obtained with ethylene oxide.

10. The composition of claim 1 wherein the polymer is a homopolymer of a butylene oxide.

11. The composition of claim 1 wherein there are 10–50 moles of a butylene oxide per mole of the polymer.

12. The composition of claim 1 which is a terpolymer of butylene oxide.

13. The composition of claim 1 wherein the antiemulsion agent is a polymer of a butylene oxide and at least one of ethylene oxide or propylene oxide.

14. The composition of claim 1 wherein there are 15–45 moles of butylene oxide per mole of the polymer.

15. The composition of claim 2 wherein the copolymer is a copolymer of butylene oxide and propylene oxide.

16. A method of reducing emulsion and/or foam formation in a lubricating oil by including therein an effective amount of:

$$HO(CH_2CH_2CH_2CH_2O)_nH$$

or a copolymer thereof wherein n is from 10 to 50.

17. A method of reducing emulsion and/or foam formation in a lubricating oil by including therein an effective amount of a butylene oxide polymer, copolymer or terpolymer.

* * * * *